US007314182B2

(12) United States Patent
Little et al.

(10) Patent No.: US 7,314,182 B2
(45) Date of Patent: Jan. 1, 2008

(54) EXTRUDED RAILROAD TIE FOR USE WITH STEEL TIE

(76) Inventors: Michael R. Little, 38135 Zuspan Rd., Middleport, OH (US) 45760; Brett Michael Little, 1354 Adamsville Rd., Bidwell, OH (US) 45614

( * ) Notice: Subject to any disclaimer, the term of this patent is extended or adjusted under 35 U.S.C. 154(b) by 0 days.

(21) Appl. No.: 10/991,825

(22) Filed: Nov. 18, 2004

(65) Prior Publication Data

US 2005/0236494 A1 Oct. 27, 2005

Related U.S. Application Data

(60) Provisional application No. 60/564,300, filed on Apr. 21, 2004.

(51) Int. Cl.
*E01B 3/00* (2006.01)

(52) U.S. Cl. ..... 238/101; 238/84; 238/95; 238/83

(58) Field of Classification Search ..... 238/83, 238/84, 82, 30, 24, 25, 29, 88, 55, 36, 56, 238/62, 63, 99, 95, 101, 102, 106; 256/1
See application file for complete search history.

(56) References Cited

U.S. PATENT DOCUMENTS

| | | | | | |
|---|---|---|---|---|---|
| 847,783 | A * | 3/1907 | Kilbourne | 238/30 |
| 992,415 | A * | 5/1911 | Fetter | 238/89 |
| 1,107,063 | A * | 8/1914 | Hamilton | 238/84 |
| 1,204,904 | A * | 11/1916 | Rogers | 238/37 |
| 1,645,514 | A * | 10/1927 | Adamy | 238/35 |
| 3,289,940 | A * | 12/1966 | Groff | 238/29 |
| 2005/0113492 | A1* | 5/2005 | Bayer et al. | 523/453 |

* cited by examiner

*Primary Examiner*—Mark T. Le
(74) *Attorney, Agent, or Firm*—Porter Wright Morris & Arthur, LLP

(57) ABSTRACT

An extruded railroad tie comprising a bottom, a first side and a second side essentially opposite each other and extending from opposite ends of the bottom and a top surface shaped to receive and support the bottom of a steel tie. The extruded tie is useful for support of railways in mines, tunnels and the like. The tie is compatible with steel ties and can withstand heavy loads, impacts, standing water, insects, bacteria, molds and the like. The tie is such that the steel tie associated with it is easily replaceable.

12 Claims, 5 Drawing Sheets

EXTRUDED RAILROAD TIE FOR USE WITH STEEL TIE

CROSS-REFERENCES TO RELATED APPLICATIONS

This application claims priority to U.S. Provisional Application No. 60/564,300 filed Apr. 21, 2004.

FIELD OF THE INVENTION

The present invention relates to a railroad tie and more particularly to a polymeric extruded railroad tie shaped to receive a steel tie.

BACKGROUND OF THE INVENTION

Railroad ties are used to support the rails of a railroad. Ties are of a given length and placed at regular intervals for the entire length of the rail system. Switch ties are longer to provide a wider base where switches are installed to switch rail transportation to a different line.

Railroad ties are traditionally constructed of wood. Wooden ties, however, eventually decompose. Decomposition is more rapid in wooden ties in contact with moisture in a hot wet climate. Insects and bacteria consume the wood and weaken the structure. Ties also crack due to absorbed water freezing and thawing and are subject to damage by equipment. When a tie deteriorates to the point it no longer sufficiently supports the rail, transportation along the rail may be disrupted until the tie is replaced. Replacement of ties consumes resources including time and profits.

Ties used in railways in underground operations, such as in tunnels and mines, are exposed to harsh conditions, including standing water, increased humidity, heavy loads and acidic conditions. Such ties deteriorate at a rapid pace due to these conditions.

Alternatives to plain wooden ties have been proposed. Treated wood, such as pressure treating and the addition of chemicals, including chromated copper arsenate or creosote, increases the wood's resistance to insects and decay. The most common treated wood currently used in the railroad market is wood treated with creosote. While treating wooden ties increases the tie's resistant to insects and decay, handling and cutting of pressure treated lumber carries health risks, and the use of creosote-soaked wood products is now banned in several states.

The cost of wood used to make railroad ties has also increasing due to decreasing supplies. Other types of materials have been developed as substitutes for wooden ties. Cast concrete ties are in use, but expensive to buy and very labor intensive to make and install. Concrete also breaks down over time when subject to freezing temperatures and acidic conditions, and cannot be inserted into track with existing wood ties.

Steel ties have been developed and are commonly used in mine and tunnel railways. A steel tie connects to and secures the rails with tie plates. Steel ties, however, typically lack good support, which shortens their lifespan compared to that of wooden ties. To add support, steel ties can be bolted to a base, creating an "iron clad tie." Iron clad ties are useful for increased weight and wear and tear on a line and currently include many shapes, typically called flat, trough, grooved, roof, and box ties.

Currently, the only bases available are wood and concrete ties, in that the top of the base must conform to the shape of the steel tie. The shaping of the wood is expensive, shaping of rested wood exposes workers to harmful chemicals, and treated wood decomposes and must eventually be replaced. Concrete also is expensive and eventually breaks down in the elements. As relevant to mine use, convention height wooden or concrete rails are impractical as iron clad ties in that the total height of a tunnel may not allow clearance of equipment transported on rails supported with conventional ties.

Composite railroad ties are a new and growing segment of the railway market. Composite ties are formed from polymeric blends that may include cellulose, chemicals, other resins and fillers that are heated and molded or extruded. Polymeric railroad ties will not rot, crack, warp, or splinter.

A typical polymer in composites is polyolefin. Polyolefin monomers are the lower olefins: ethylene, propylene, butylene and isoprene. Polyolefins are made by joining these monomers to form long-chain polymers, such as polypropylene and polyethylene. Polyolefins are thermoplastic polymers, in that they become elastic upon heating and firm when cool, and, upon reheating and re-cooling, do not becoming brittle.

Composite ties are denser than wood and maintenance free in that they are waterproof and unaffected by insects, bacteria and molds. Composite ties, however, are sometimes heavy and difficult to install.

A need exists for an easy to install, lightweight, weather resistant tie able to serve as a base for a steel tie, which is insect, bacteria, mold and chemical resistant, eliminates environmental concerns and reduces the exposure of workers to hazardous materials. A need exists for a tie capable of supporting a steel tie for use in railways in mines, tunnels and the like.

SUMMARY OF THE INVENTION

The present invention relates to a tie for use in railways supported with steel ties, particularly for support of rails in mines and tunnels. The tie is made of a polymer blend having a top portion substantially conforming to the bottom shape of a steel tie. The tie is a thermoplastic blend formed by extrusion. The die used to extrude the tie varies to produce a final shape of the tie conforming to a steel tie. The tie is cut into any length after forming. The tie may be predrilled or drilled at the installation site for insertion of one or more than one bolt to secure the tie to the steel tie.

The present invention is an extruded railroad tie body. The body comprising a bottom, a first side and a second side essentially opposite each other and extending from opposite ends of the bottom and a top surface shaped to receive the bottom of a steel tie.

The invention further includes a shaping apparatus to extrude a tie for use in supporting a railway for use with a steel tie. The shaping apparatus may be a die with a cavity shaped to produce a tie having a bottom, a first side and a second side essentially opposite each other and extending from opposite ends of the bottom, and a top surface shaped to receive the bottom of a steel tie.

The invention is a method of making an extruded tie by heating a predetermined polymeric blend to produce a melt, extruding the melt through a die comprising a cavity that conforms to a shape of a bottom surface of a steel tie, and cooling and cutting the formed tie to a desired length.

The tie is inert in moist and acidic conditions and can be used in place of conventional natural wood ties, particularly those used in mines and tunnels. The tie is compatible with steel ties and can withstand heavy loads, impacts, standing water, insects, bacteria, molds and the like. The tie is such that the steel tie associated with it is easily replaceable.

Features, aspects, advantages and objects presented and accomplished by the present invention will become apparent and or be more fully understood with reference to the following description and detailed drawings of preferred and exemplary embodiments.

DETAILED DESCRIPTION OF THE INVENTION

In one aspect of the invention, there is provided an extruded tie for use in connection with steel ties connected to a railway, and more particularly rails in mines and tunnels, as a superior replacement for wood ties. Accordingly, the invention features a tie comprising a body having a top portion shaped to support the bottom of a steel tie, to be disposed between the steel tie and the ground, ballast, cement, or other bed of a railway. The railway may be located in a mine, tunnel or other like environment.

Figures 1A, 1B, 1C:
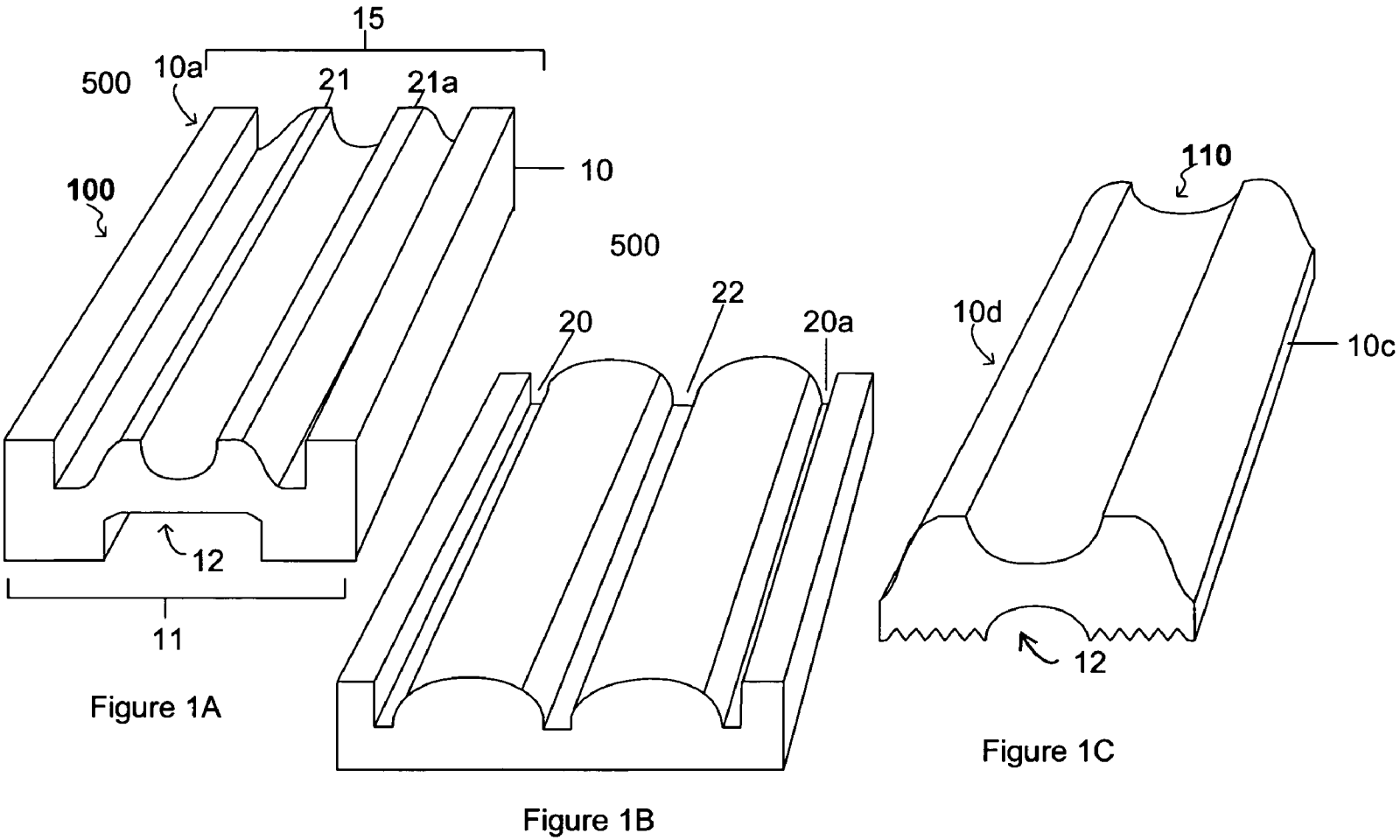
FIGS. 1A-1C are perspective views of several embodiments of the extruded ties.
Figure 1D:
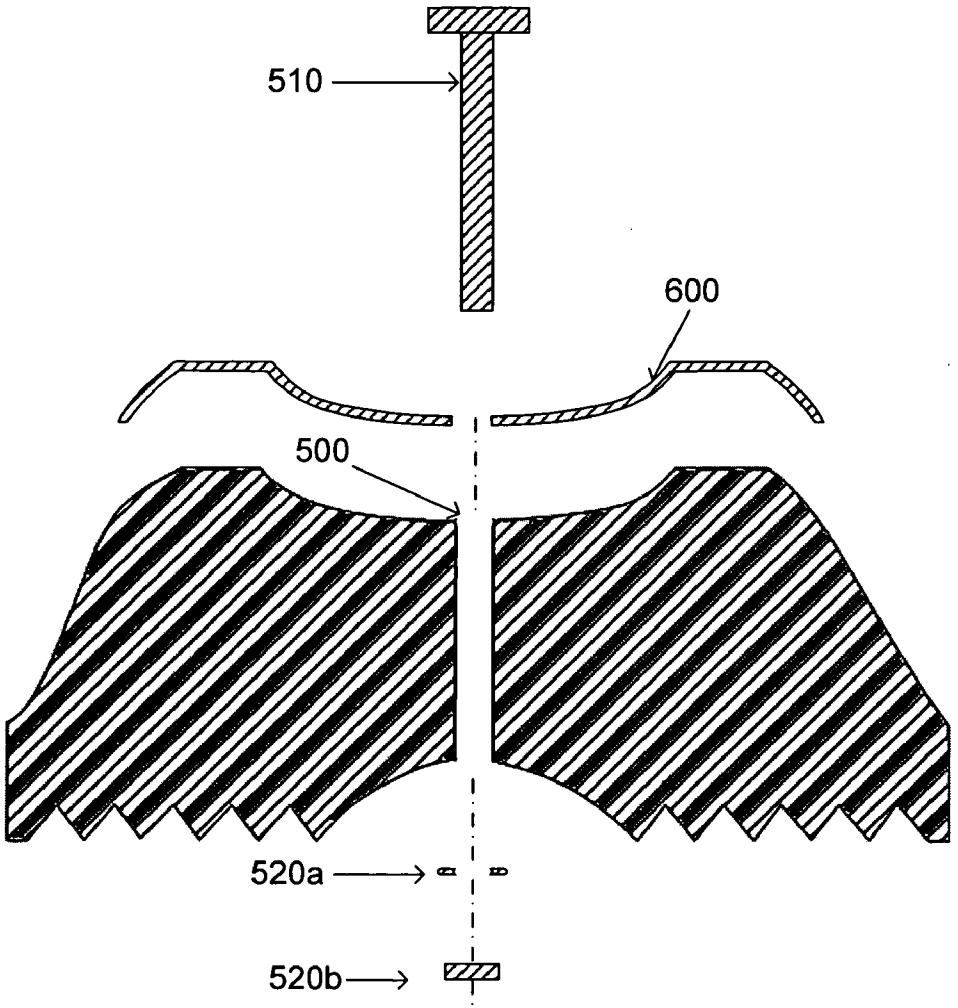

FIG. 1 illustrates several embodiments of the present invention. The tie is comprised of a polymer, polymer blend, composite polymer, or any suitable polymer or polymer mixed with additives. The polymer blend comprising the tie may be selected from the thermoplastic polymers, such as the polyolefins, or any other similarly suitable combination of polymers that provides sufficient flexibility, strength, lightness, stability, impermeability and easy processability for extruding the tie. Contemplated polyolefins include, but are not limited to, the $C_2$-$C_8$ polyolefins and their copolymers, included but not limited to polypropylene, polyethylene, and ethylene vinyl acetate. The polymer blend may comprise recycled, off grade, reprocessed, regrind, and or virgin formulation of components blended optionally with resins, chemicals, additives and/or fillers. Fillers include cellulose, such as wood and/or other vegetative fibers, recycled materials, such as tires, door mats, and the like.

Figure 2:
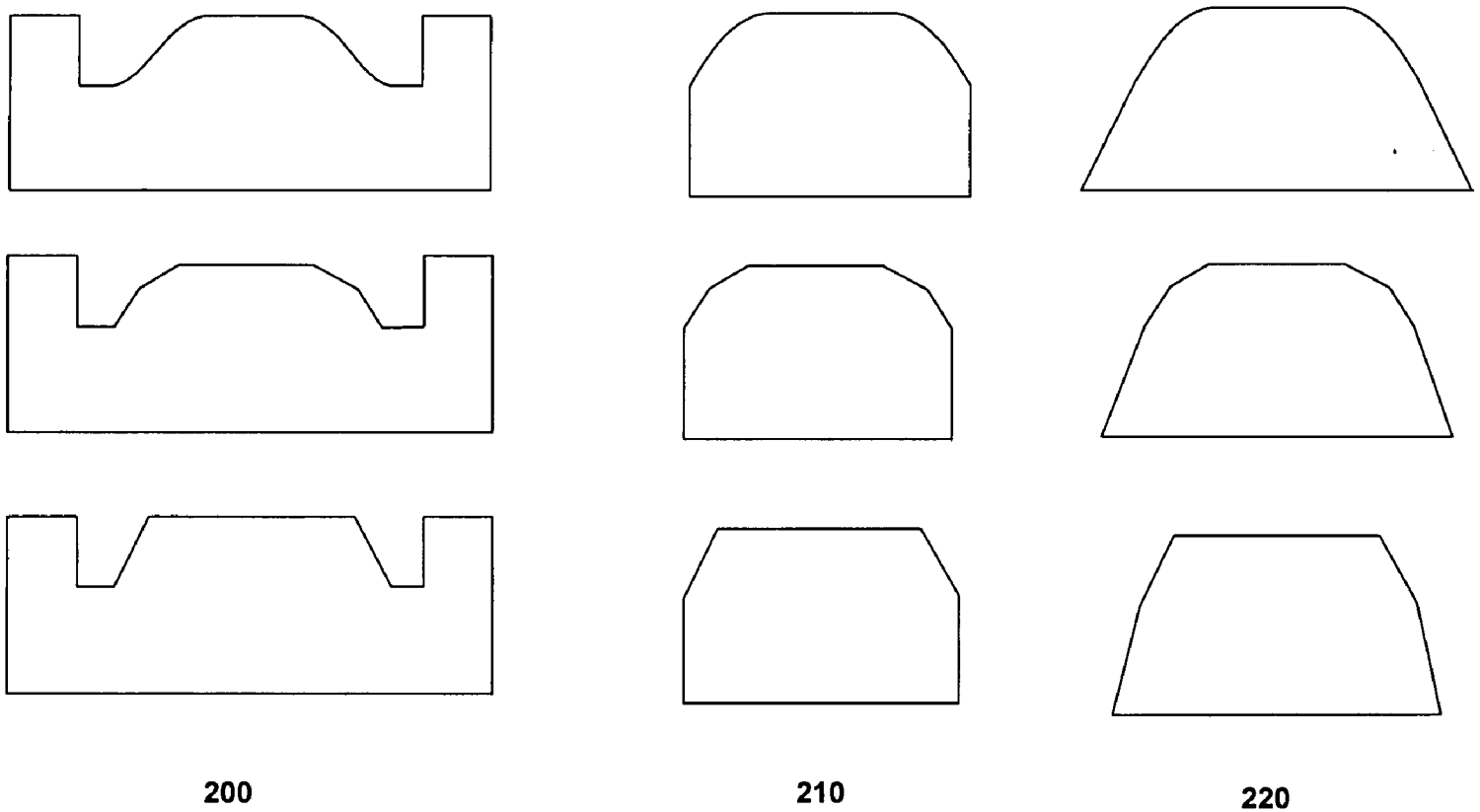
FIG. 2 shows several embodiments of basic dies used to extrude the tie.

In an embodiment comprising a polyolefin, the materials are combined and thermally fluidized, homogenized and extruded by forcing the heated polymer through a die orifice, which produces the final shape of the finished product. Shapes include those that conform to the most common steel ties. The polymer blend is extruded with the use of conventional extrusion processing with the shaping apparatus of the present invention producing a tie having a top portion shaped to receive a variety of steel ties. The shaping apparatus comprises one or more die used to produce the desired shape of the tie. FIG. 2 depicts basic shapes used for dies. The dies are modified to produce shapes contemplated herein.

In the extrusion process used to create the tie of the present invention, a predetermined polymeric blend is heated and extruded through a die selected to form a shape that conforms to a particular steel tie. The die is further shaped to eliminate areas of the tie not required for support on order to reduce costs and overall weight of the tie. The die has a cavity shaped in the desired shape of a tie. The melt is forced through the die, cooled and collected.

When the formed tie passes though the die, it is a continuous length solid extruded shape, with or without projections and having angular and or curved portions forming the final shape of the tie. The extrusion is performed continuously, then cooled and the tie cut to predetermined lengths for given gauges of rails or other uses. The tie may be optionally predrilled upon manufacture or at the installation site to accept one or more bolt for fastening to the steel tie.

As shown in FIG. 1, the tie functions similarly to a wooden tie to support a steel tie to form what is commonly known as an "iron clad" tie. In an embodiment of the invention, the tie is approximately 3 inches in height and approximately 7 inches in breadth to function as an iron clad tie for use in a tunnel. Alternatively, the tie may be smaller or of similar height and breadth as that of a conventional wooden tie. The tie may be cut to any desired length.

The tie comprises a first side 10 and second side 10*a*. In an embodiment, the sides extend substantially at right angles from a bottom 11. The sides may be planar or curved and may optionally include grooves or other modifications to the shape. In an embodiment, the sides extend equal distance from the bottom; however, unequal height sides are contemplated in the invention. In an embodiment of the invention, the sides extend approximately 3 inches from the bottom to accommodate a steel tie and provide a low profile support for rails in a tunnel, mine, or the like. Alternate embodiments of the tie include lower or higher profile sides. In an embodiment, the sides may be equal in height to that of a conventional wooden tie.

In an embodiment, the height of the sides 10*b*, 10*c* of the tie may be less than the overall height of the tie. In an embodiment, the steel tie may extend over one or more side of the tie, or alternatively abut to the end of one or more side of the tie at the end distal to the bottom.

Figure 3:
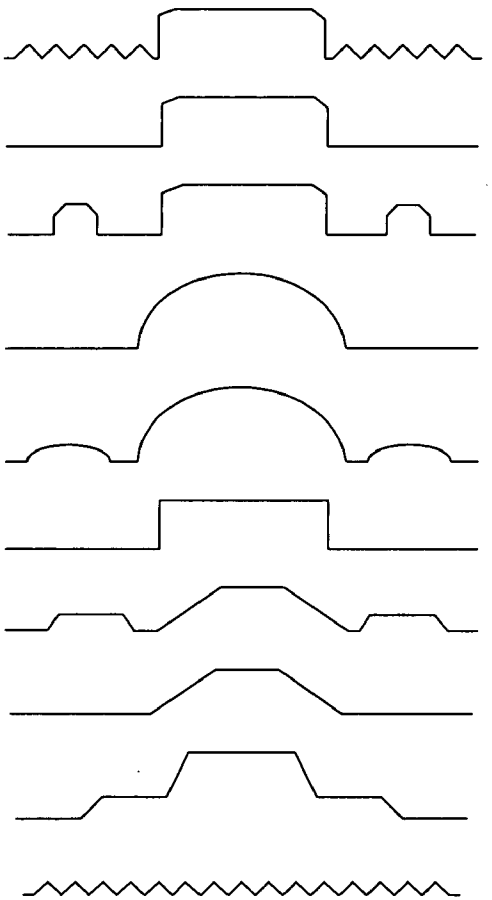
FIG. 3 depicts several embodiments of shapes of the bottom of the tie.

The bottom 11 may be substantially flat, or may be angular or curvilinear to adapt to the ground, cement, ballast or other surface. In an embodiment, the bottom 11 comprises a chamfer 12. Alternatively, the bottom may comprise other recesses, angles and shapes to reduce the weight of the tie and or to add resistance to movement against, and maintain the tie's position in or on the ballast, ground, cement, etc., upon which the tie is placed. The chamfer 12 and or other recesses, angles and shapes extend the length of the bottom of the tie. FIG. 3 depicts several embodiments of bottom shapes and chamfers contemplated by the invention.

The chamfer 12 may be of any shape, depth and width, provided structural support for the steel tie and railway is maintained. In an embodiment, the chamfer is relatively centered an equal distance from each of the sides. The chamfer is adapted to receive at least one nut and washer to secure at least one bolt extending through the tie into the chamfer. The washer, nut and extending portion of the bolt are thus distanced from the ground, ballast, or other surface upon which the tie is placed. The chamfer 12 preferably extends no more than approximately one-third of the total height at least one side from an end of the side distal to the bottom end.

Referring again to FIG. 1, the tie further comprises a top surface 15. The top surface is alternatively shaped to accept the bottom surface of a variety of steel tie. In one embodiment 100 the top surface 15 is approximately 8 inches in linear width. In another embodiment 110, the top surface is approximately 6 inches in width. One skilled in the art should readily realize that the linear width of the top surface is contemplated to conform to a steel tie to be attached and thus is not restricted to the examples provided. In an embodiment, the width of the top surface 15 is substantially equal to the width of the bottom 11. Alternatively, as shown in several embodiments of dies used to shape a tie depicted in FIG. 2, the bottom is wider that the top surface (Column 220). In such embodiments the sides of the tie form acute angles with the bottom.

The top surface 15 of the tie is alternatively shaped to receive a variety of steel ties. The invention is adaptable to receive current steel ties as well as those contemplated in the future. In an embodiment, the top surface 15 extends at a substantially right angle from each of the sides. In an embodiment, the top surface 15 indents at a given distance from each side to provide an abutment for and accept the side ends of current steel ties. Each indent 20, 20*a* extends the length of the tie. Several embodiments of dies shaped to form a top surface with indents are embodiments depicting in Column 200 of FIG. 2.

Figure 4:
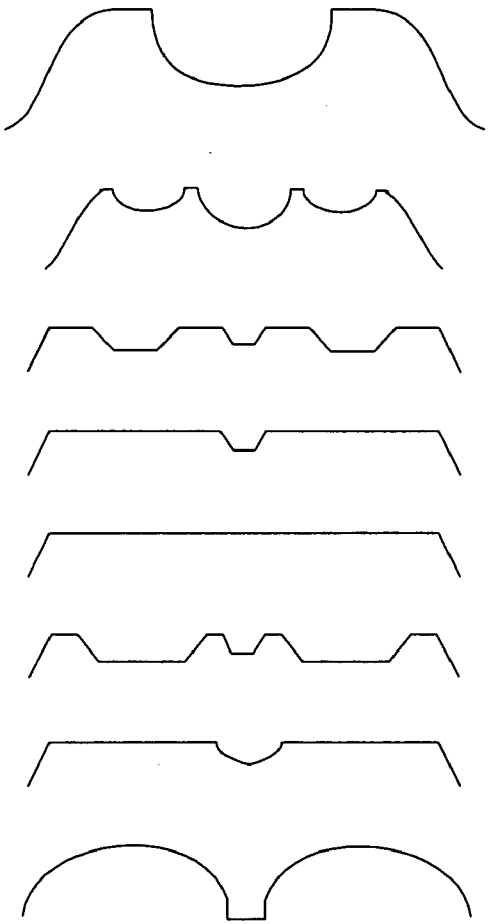
FIG. 4 depicts several embodiments of top shapes, which may include side extensions, of the tie.

The top surface 15 extends center ward from each indent 20, 20*a* in a shape to conform to a steel tie. Contemplated shapes include but are not limited to flat, trough, grooved, roof, and box steel ties. Several embodiments of top surfaces of the tie are depicted in FIG. 4.

Alternatively, the top surface 15 does not comprise indents. Column 210 of FIG. 2 depicts several embodiments of dies used to shape such ties. In these embodiments, the steel tie may enclose the top surface of the tie.

The top surface may be shaped to support any steel tie. FIG. 4 depicts several embodiments of top surfaces. As shown in FIG. 4, the top surface may comprise additional chamfers, grooves and or channels to eliminate portions not required for support.

In an embodiment 100 depicted in FIG. 1 and shaped to support a trough steel tie, the top surface 15 comprises a modified convex curve extending from the indent 20, 20*a* to a first high point 21 and a second high point 21*a*. Such curves support the bottom surface of the steel tie. Alternatively, the curves may comprise channels or grooves to reduce the weight of the tie in areas not essential to support the steel tie and the railway.

As shown in several embodiments of dies used to shape the top surface 15 depicted in FIG. 4, the top surface may alternately be planar, rounded, and or angled. The top surface may or may not be essentially parallel to the bottom.

Figure 5:
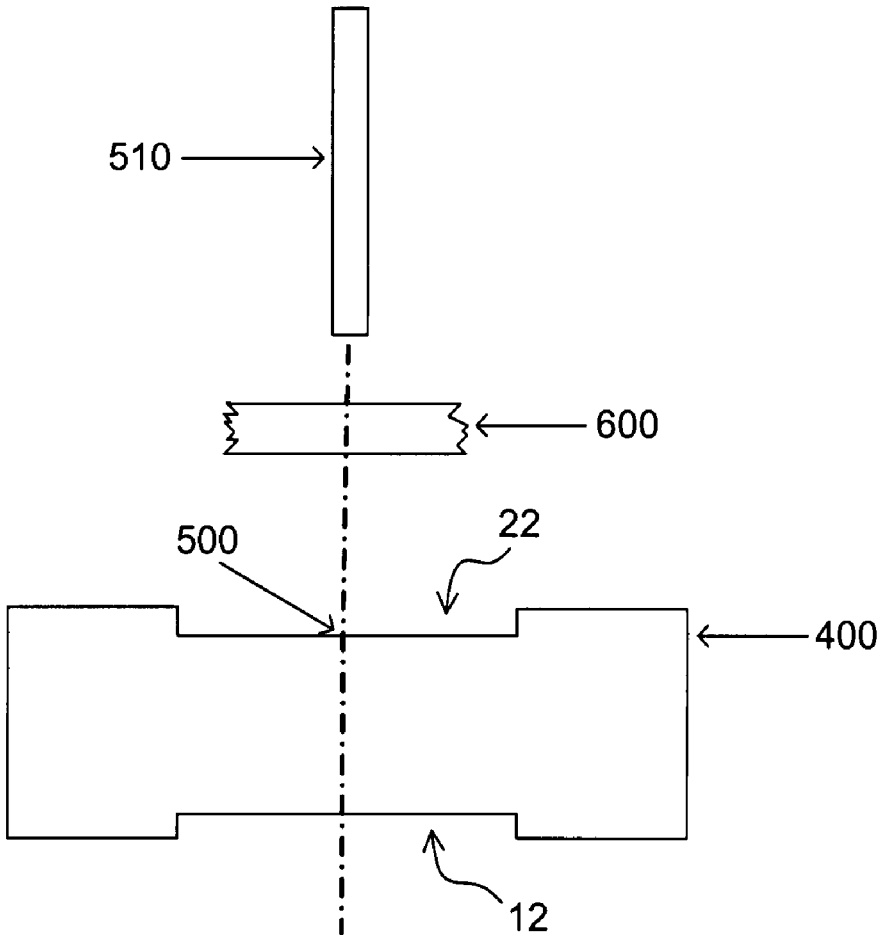
FIG. 5 is a box diagram showing representations of a tie, a steel tie, and a fastener for securing the tie and the steel tie together. The sizes and shapes as shown in FIG. 5 do not represent the specific sizes and shapes of the structure of the present invention.

FIG. 5 is a box diagram showing the arrangement of tie 400, steel tie 600 and fastener 510. Tie 400 is channeled in an area corresponding to a center piece of a trough or grooved steel tie 600. The channel 22 runs the length of the tie and is adapted to receive at least one bolt 510 to secure the steel tie to the tie of the invention. The tie may be optionally drilled at one or more predetermined section of the channel to receive one or more bolts. The channel enables a head of the bolt to be located below the outer most surface of the top surface. The predrilled holes 500 and bolts extend from the top surface to the chamfer 12 or bottom for attachment of one or more washer and or nut.

One skilled in the art will understand that the description of the present invention herein is presented for purposes of illustration and that the design of the present invention should not be restricted to only one configuration or purpose, but rather may be of any configuration or purpose which essentially accomplishes the same effect.

The foregoing descriptions of specific embodiments and examples of the present invention have been presented for purposes of illustration and description. They are not intended to be exhaustive or to limit the invention to the precise forms disclosed, and obviously many modifications and variations are possible in light of the above teachings. It will be understood that the invention is intended to cover alternatives, modifications and equivalents. The embodiments were chosen and described in order to best explain the principles of the invention and its practical application, to thereby enable others skilled in the art to best utilize the invention and various embodiments with various modifications as are suited to the particular use contemplated.

It is therefore to be understood that within the scope of the appended claims, the invention may be practiced otherwise than as specifically described herein.

What is claimed is:

1. A plastic extruded railroad tie comprising:

a bottom, said bottom comprising a chamfer;

a first side and a second side essentially opposite each other and extending from opposite ends of the bottom; and a top surface, said top surface comprising a channel receiving a bottom surface of a steel tie; and at least one opening, said opening extending from the chamfer to the channel, said opening receiving a securing means that secures the steel tie to the plastic extruded tie.

2. The extruded tie of claim 1 wherein the tie is formed from a substance selected from the group of a polymer, a polymer blend, and a composite polymer.

3. The extruded tie of claim 2 wherein an additive and or a filler is added to the substance.

4. The extruded tie of claim 1 wherein the sides are planar or curved.

5. The extruded tie of claim 1 wherein the sides each extend substantially at right angles from the bottom.

6. The extruded tie of claim 1 wherein the sides further comprise one or more indentation and or one or more convexity.

7. The extruded tie of claim 1 wherein the sides extend an unequal distance from the bottom.

8. The extruded tie of claim 1 wherein at least a portion of the bottom of the railroad tie is one of substantially flat, angular and curvilinear.

9. The extruded tie of claim 1 wherein the bottom comprises one or more indentation and or one or more convexity.

10. The extruded tie of claim 1 wherein the bottom is wider that the top surface.

11. The extruded tie of claim 1 wherein the top surface comprises opposite abutments, each abutment to accept a side end of a steel tie.

12. The extruded tie of claim 1 wherein the top surface is a shape selected from the group planar, round, angled, trough, grooved, roof, and box.

* * * * *